US006155444A

United States Patent [19]

Liu

[11] Patent Number: 6,155,444

[45] Date of Patent: Dec. 5, 2000

[54] COLLAPSIBLE PLASTIC CONTAINER

[75] Inventor: Kun-Hei Liu, Taipei, Taiwan

[73] Assignee: Green Wheel Industrial Co., Ltd., Taipei, Taiwan

[21] Appl. No.: 09/487,903

[22] Filed: Jan. 19, 2000

[51] Int. Cl.[7] ..... B65D 21/00

[52] U.S. Cl. ..... 220/7

[58] Field of Search ..... 220/7, 6

[56] References Cited

U.S. PATENT DOCUMENTS

| | | | |
|---|---|---|---|
| 3,675,808 | 7/1972 | Brink | 220/7 |
| 5,195,644 | 3/1993 | Schmid | 220/7 |
| 5,282,542 | 2/1994 | Mo | 220/7 |
| 5,344,004 | 9/1994 | Meyer | 220/7 |
| 5,671,857 | 9/1997 | Stromberg | 220/7 |
| 5,746,342 | 5/1998 | Jacques et al. | 220/7 |
| 6,015,056 | 1/2000 | Overholt et al. | 220/7 |

*Primary Examiner*—Joseph M. Moy
*Attorney, Agent, or Firm*—Varndell & Varndell, PLLC

[57] ABSTRACT

A collpasible platic container having a rectangular base panel, two short side panels and two long side panels respectively disposed at the four sides of the base panel, hinge strips respectively formed between the base panel and the side panels, the long side panels each having a coupling tongue coupled to a respective coupling groove at one short side panel, and a plurality of studs respectively fastened to respectively plug holes on a respective hinged coupling flange at the second short side panel.

1 Claim, 2 Drawing Sheets

COLLAPSIBLE PLASTIC CONTAINER

BACKGROUND AND SUMMARY OF THE INVENTION

The present invention relates to a plastic container, and more particularly to such a collapsible plastic container that can be collapsed into a flat manner to minimize space occupation when not in use.

A variety of plastic containers are available on the market. These plastic containers are inexpensive to manufacture because they are commonly injection-molded from plastics. Further, these plastic containers have a certain height. However, these plastic containers are not collpasible. When not in use, these plastic containers commonly occupy much storage space.

It is one object of the present invention to provide a platic container, which is collpasible. It is another object of the present invention to provide a collapsible plastic container, which is easy and inexpensive to manufacture. According to the present invention, the collapsible plastic container is formed of a plastic board injection-molded from plastic subject to a predetermined pattern. The plastic board comprises a rectangular base panel, two short side panels and two long side panels respectively hinged to the four sides of the base panel. One short side panel comprises two coupling grooves respectively fastened to respective coupling tongues at the long side panels. The other short side panel has hinged coupling flanges with plug holes respetively fastened to respective studs at the long side panels.

DETAILED DESCRIPTION OF THE PREFERRED EMBODIMENT

Figure 1:
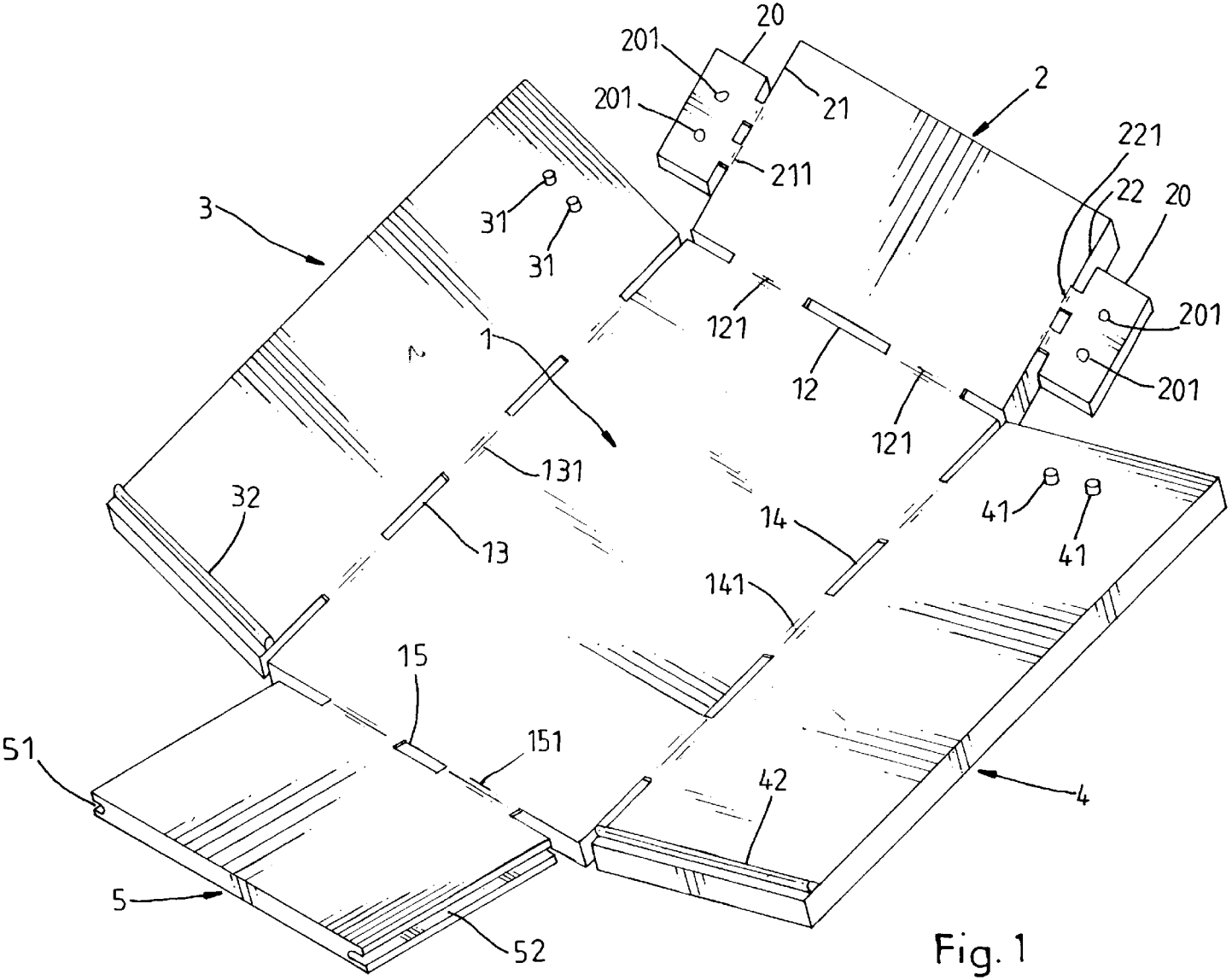
FIG. 1 is an extended out view of a collapsible plastic container according to the present invention.
Figure 2:
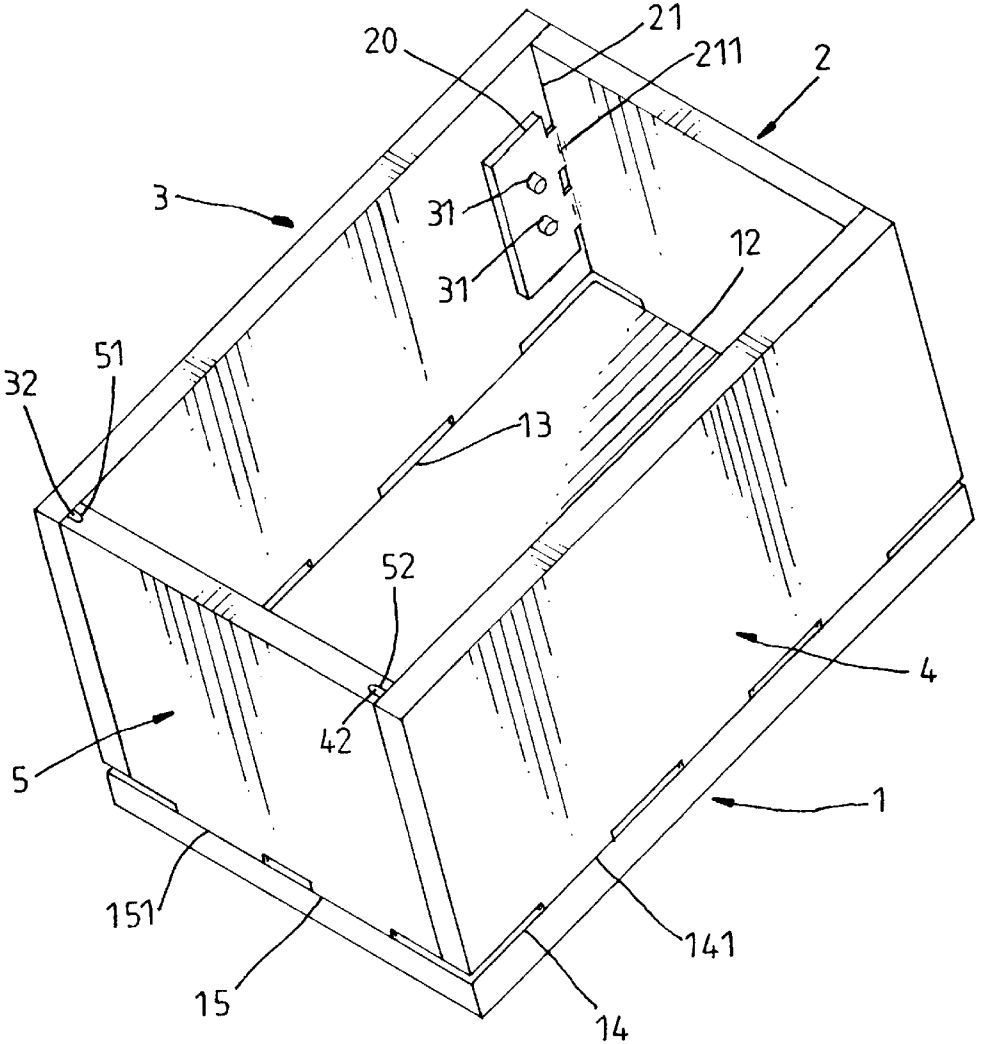
FIG. 2 is a perspective assembly view of the collapsible plastic container according to the present invention.

Referring to FIGS. 1 and 2, a collapsible plastic container is made of a base board injection-molded from plastics, comprising a rectangular base panel 1 having four sides 12, 13, 14 and 15, two short side panels 2 and 5 respectively connected to the two short sides 12 and 15 of the base panel 1, two long side panels 3 and 4 respectively connected to the two long sides 13 and 14 of the base panel 1, and hinge strips 121, 131, 141 and 151 respectively formed integral with the base panel 1 and the side panels 2, 3, 4 and 5 and connected between the four sides 12, 13, 14 and 15 of the base panel 1 and the side panels 2, 3, 4 and 5. The long side panels 3 and 4 each have a transverse coupling tongue 32 or 42 near one end, and a plurality of studs 31 or 41 near an opposite end. One short side panel 2 comprises two opposite lateral sides 21 and 22, two coupling flanges 20 respectively extended from the lateral sides 21 and 22, hinge strips 211 and 221 respectively connected between the lateral sides 21 and 22 of the short side panel 2 and the couling flanges 20, and a plurality of plug holes 201 respectively formed on the coupling flanges 20. The other short side panel 5 comprises two coupling grooves 51 and 52 at two opposite ends thereof. During assembly process, the side panels 2, 3, 4 and 5 are respectively folded up, and the coupling flanges 20 of the short side panel 2 are respectively bent inwards and fastened to the long side panels 3 and 4, enabling the studs 31 and 41 to be respectively plugged into the plug holes 201 on the coupling flanges 20 of the short side panel 2, and the short side panel 5 is connected between the long side panels 3 and 4, enabling the transverse coupling tongues 32 and 42 of the long side panels 3 and 4 to be forced into engagement with the coupling grooves 52 at the short side panel 5 respectively.

Further, a hand hole may be made on one side panel 5. Through the hand hole, the plastic container can be conveniently carried by hand.

What is claimed is:

1. A plastic container comprising a rectangular base panel having four sides, a first side panel, a second side panel, a third side panel and a fourth side panels respectively connected to the four sides of said base panel, a plurality of hinge strips respectively connected between the four sides of said base panel and said side panels, said first side panel and said second side panel being disposed at two opposite sides, said third side panel and said fourth side panel being disposed at two opposite sides and respectively connected between said first side panel and said second side panel, said first and second side panels each having a coupling tongue near one end and a plurality of studs near an opposite end, said third side panel comprising two coupling flanges hinged to two opposite lateral sides thereof, said coupling flanges each having a plurality of plug holes respectively coupled to the studs at said first side panel and said second side panel, said fourth side panel comprising two coupling grooves disposed at two opposite ends thereof and respectively engaged with the coupling tongues at said first side panel and said second side panel.

* * * * *